US008215617B2

(12) United States Patent
Liou

(10) Patent No.: US 8,215,617 B2
(45) Date of Patent: Jul. 10, 2012

(54) PRYING TOOL

(76) Inventor: Mou-Tang Liou, Ta Li (TW)

( * ) Notice: Subject to any disclaimer, the term of this patent is extended or adjusted under 35 U.S.C. 154(b) by 809 days.

(21) Appl. No.: 12/331,532

(22) Filed: Dec. 10, 2008

(65) Prior Publication Data

US 2010/0140575 A1 Jun. 10, 2010

(51) Int. Cl.
*B66F 15/00* (2006.01)

(52) U.S. Cl. ..... 254/131.5; 254/131

(58) Field of Classification Search ..... 254/131, 254/131.5, 21, 25, 28, 129; 7/166, 143
See application file for complete search history.

(56) References Cited

U.S. PATENT DOCUMENTS

2010/0140575 A1* 6/2010 Liou ..... 254/131.5

FOREIGN PATENT DOCUMENTS

TW M315635 7/2007

* cited by examiner

*Primary Examiner* — Lee D Wilson

(74) *Attorney, Agent, or Firm* — Alan Kamrath; Kamrath IP Lawfirm, PA

(57) ABSTRACT

A prying tool includes a shank having an engaging portion and two prongs moveably mounted on the engaging portion of the shank. The prongs define a space therebetween such that an item to be pried is received in the space. The prongs are operably moveable so that the space is variable in size. Further, two positioning devices are utilized for holding the two prongs stationary with respect to the engaging portion of the shank respectively.

19 Claims, 13 Drawing Sheets

PRYING TOOL

BACKGROUND OF THE INVENTION

1. Field of the Invention

The present invention relates to a prying tool of the type which includes two prongs defining a gap therebetween such that an item to be pried is received in the gap, and in particular, of the type in which the two prongs are operably moveable in a ready manner.

2. Description of the Related Art

A prying tool of the type which includes two prongs and defines a gap between the two prongs is known. Generally, for the sake of mass production, the gap is fixed in size. However, a user sometimes may encounter a situation that the item is too big to be received by the gap or a situation that the gap is too big for the user to efficiently pry the item. So, TW Pat. No. M315635 teaches a prying tool including a group of shanks each including a gap differentiated in size from the others. However, it is trouble to have all the group of shanks in hand, and, besides, they are not light to be carried around.

The present invention is, therefore, intended to obviate or at least alleviate the problems encountered in the prior art.

SUMMARY OF THE INVENTION

According to the present invention, a prying tool includes a shank including an engaging portion and a gripping portion connected transversely to the engaging portion. In this regard, a user holds the gripping portion when using the prying tool. Two prongs are moveably mounted on the engaging portion of the shank and each includes a connecting portion connected to the engaging portion of the shank and a working portion projected from the connecting portion. The two working portions define a space therebetween such that an item to be pried is received in the space.

The space has a first size when one of the two prongs is positioned at a proximal end of the shank and the other of the two prongs is positioned at a distal end of the shank. Further, the space has a second size when the two prongs are in proximity to each other. Since the prongs are moveable, the size of the space is thus variable between the first and second sizes.

The prying tool also includes two positioning devices for holding the two prongs stationary with respect to the engaging portion of the shank respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DETAILED DESCRIPTION OF THE PREFERRED EMBODIMENTS

Figure 1:
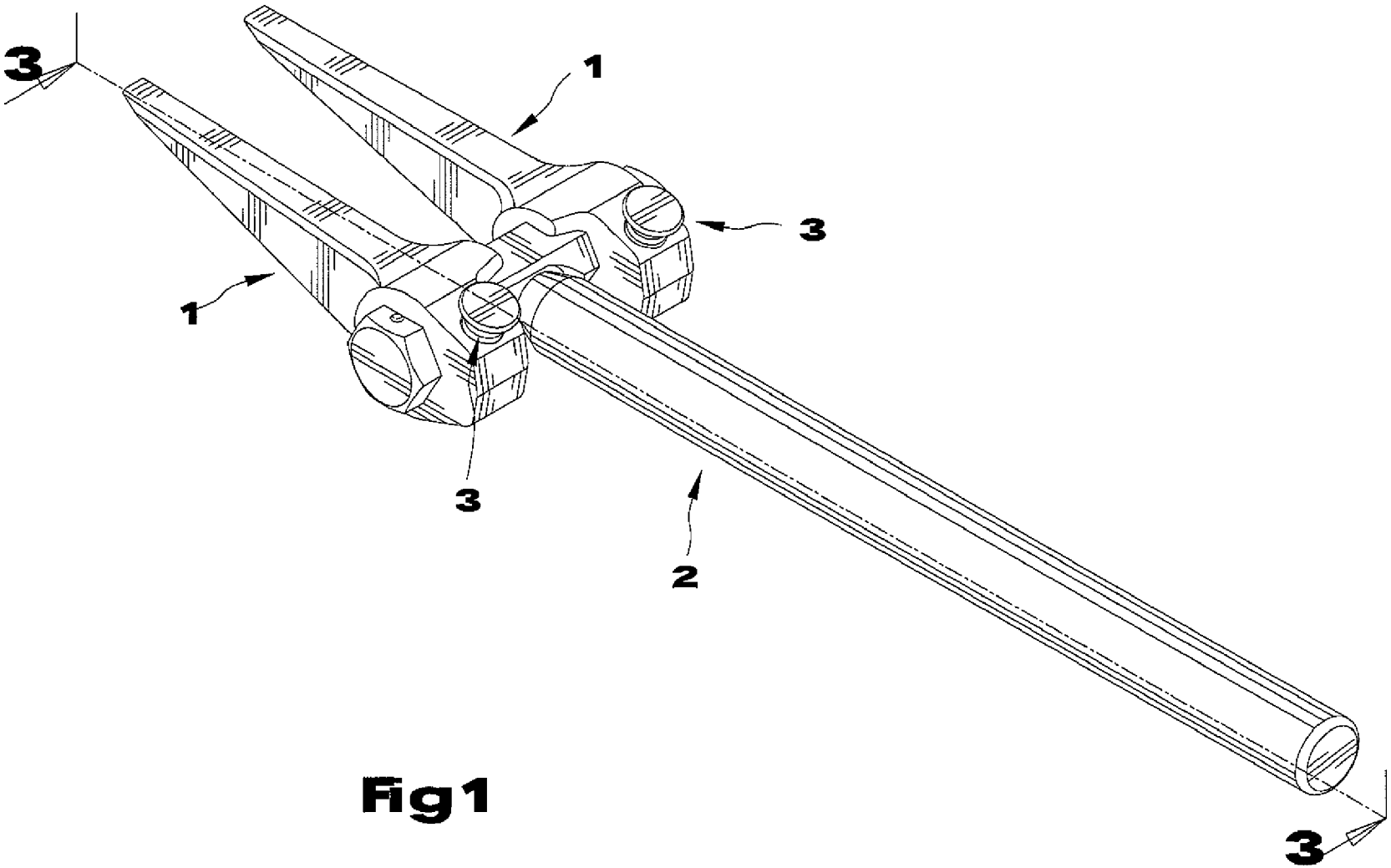
FIG. 1 is a perspective view of a prying tool in accordance with a first embodiment of the present invention.
Figure 2:
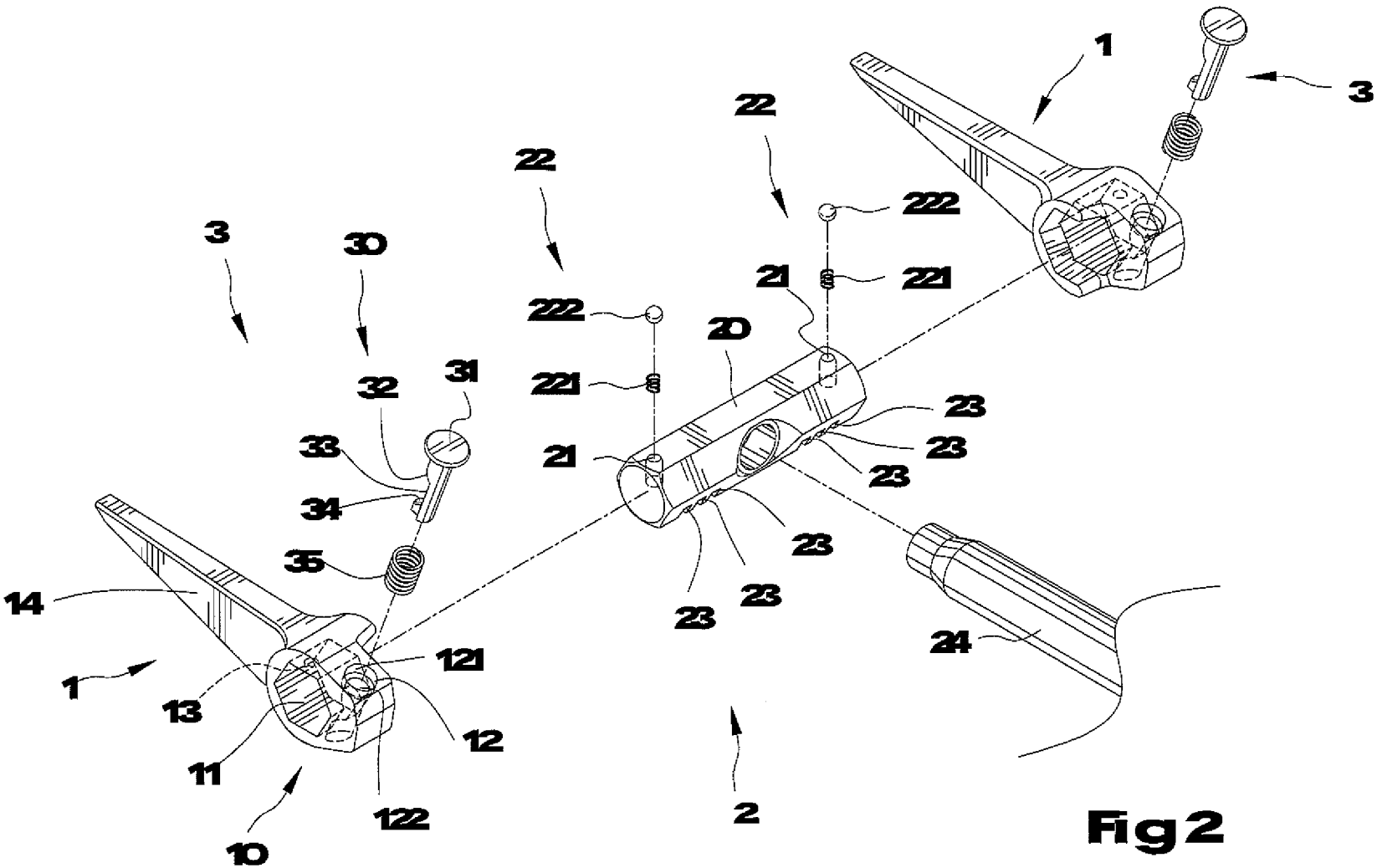
FIG. 2 is an exploded perspective view of the prying tool shown in FIG. 1, with a gripping portion of the prying tool shown partially.
Figure 3:
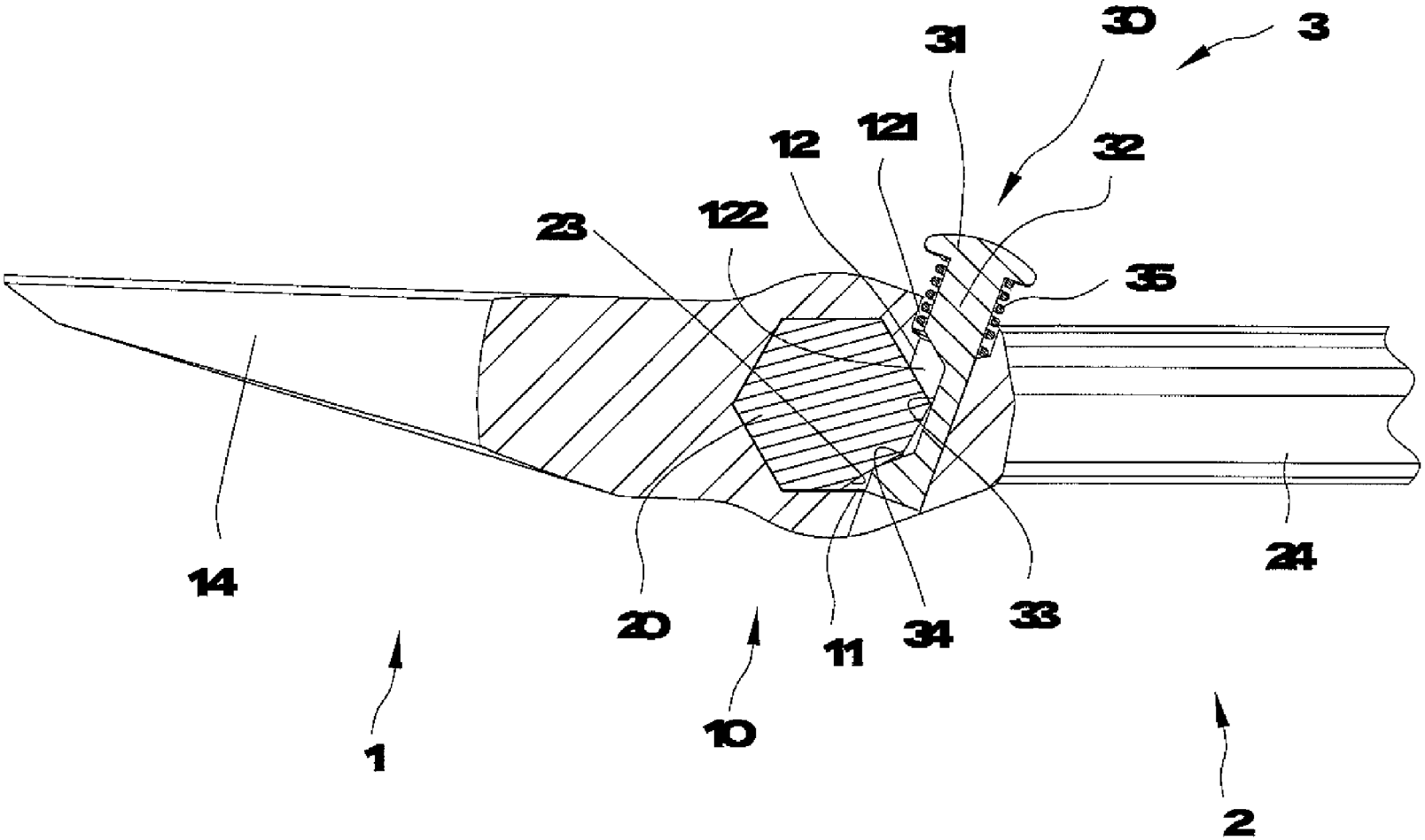
FIG. 3 is a cross-sectional view taken along line 3-3 of FIG. 1.
Figure 4:
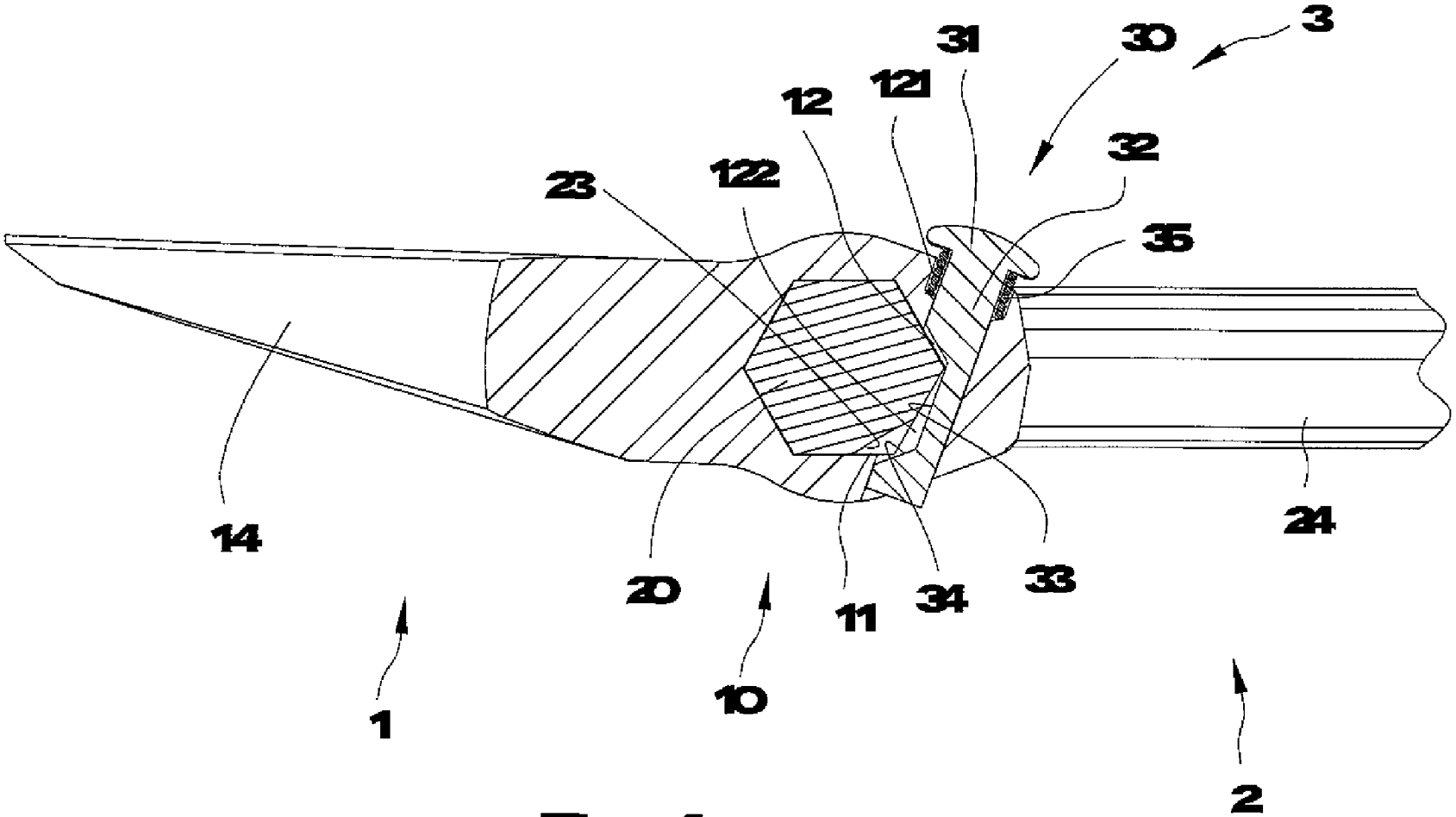
FIG. 4 is another cross-sectional view similar to FIG. 3, but illustrating a position device of the prying tool in another position.
Figure 5:
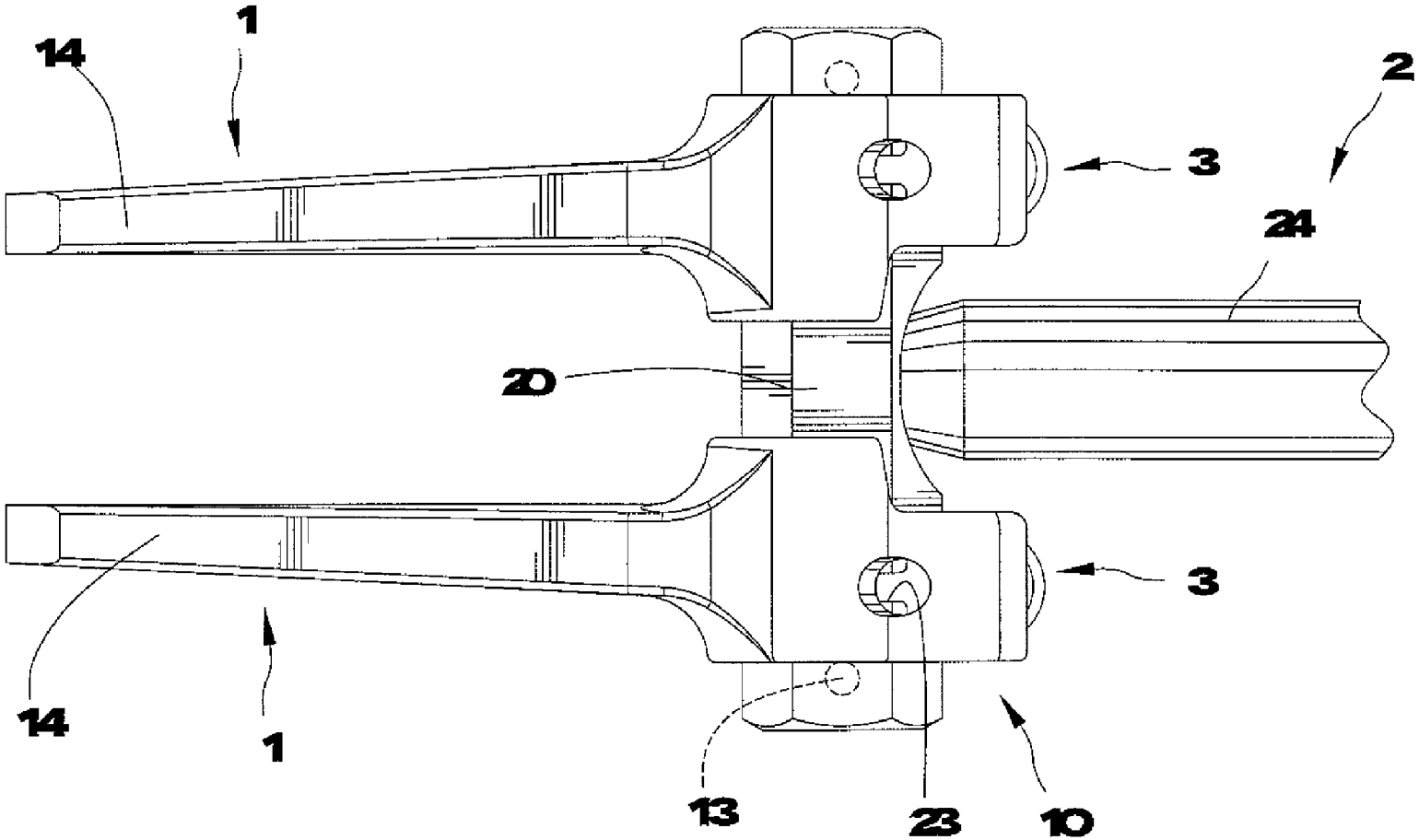
FIG. 5 is a partial, bottom view of the prying tool shown in FIG. 1.
Figure 6:
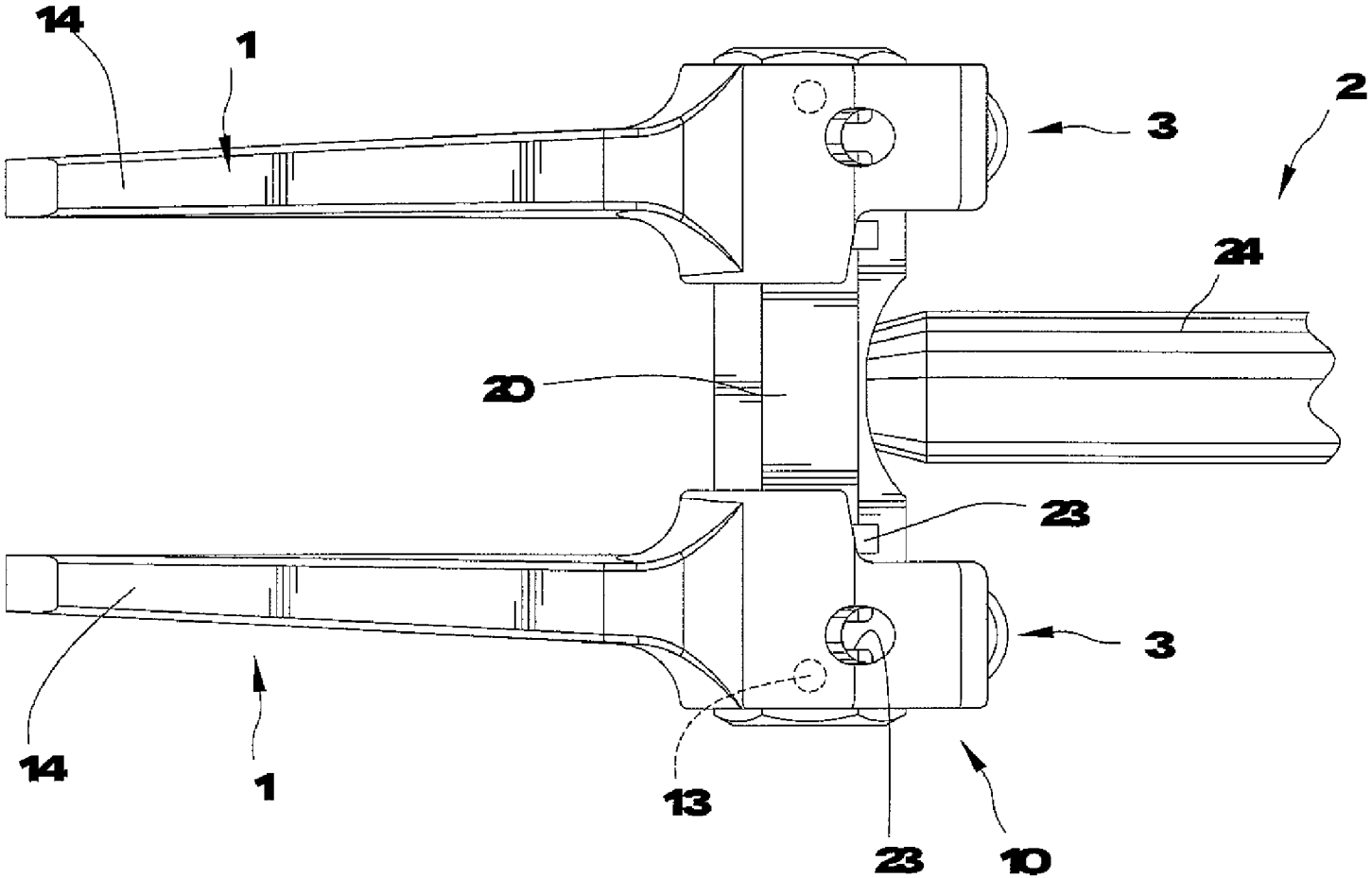
FIG. 6 is another bottom view similar to FIG. 5, but illustrating two prongs of the prying tool in other positions.

FIGS. 1 through 8 show a prying tool in accordance with a first embodiment of the present invention. The prying tool includes a shank 2 including an engaging portion 20 and a gripping portion 24 for a user to hold during operation thereof. The gripping portion 24 is releasably connected transversely to the engaging portion 20 and connected at a middle of the engaging portion 20. It is, however, contemplated that the engaging portion 20 and the gripping portion 24 are formed integrally.

The engaging portion 20 of the shank 2 includes a polygonal periphery having a plurality of retaining portions 23 thereon. The plurality of the retaining portions 23 is recesses inset on the engaging portion 20 of the shank 2. Further, the retaining portions 23 are aligned with each other in a first direction and are disposed on one of the plurality of corners.

Two prongs 1 are moveably mounted on the engaging portion 20 of the shank 2, and each includes a connecting portion 11 and a working portion 14 projected from the connecting portion 10. The connecting portion 10 is connected to the engaging portion 20 of the shank 2. In this embodiment, each connecting portion 10 includes a through hole 11, and the engaging portion 20 of the shank 2 includes a proximal end inserted through the through hole 11 of one of the two prongs 1 and a distal end inserted through the through hole 11 of the other of the two prongs 1. Additionally, each connecting portion 10 includes a compartment 12 in communication with the through hole 11, and the compartment 12 moveably receives a positioning device 3. Preferably, the compartment 12 includes a large diametrical section 121 and a small diametrical section 122. Further, the engaging portion 20 of the shank 2 includes two portions of the periphery received by the two compartments 12.

The two working portions 14 define a space (not numbered) therebetween such that an item (not shown) to be pried is received in the space. The space has a first size when one of the two prongs 1 is positioned at the proximal end of the shank 2 and the other of the two prongs 1 is positioned at a distal end of the shank 2. Further, the space has a second size when the two prongs 1 are in proximity to each other. Since the prongs 1 are moveable, the size of the space is thus variable between the first and second sizes. Additionally, the two prongs 1 are adapted to be prevented from detaching from the engaging portion 20 of the shank 2 by two detent devices 22 respectively. The two detent devices 22 are disposed in proximity to the proximal and distal ends of the engaging portion 20 of the shank 2. In this embodiment, each of the two prongs 1 includes a dent 13, and each of the two detent devices 22 includes a cavity 21 on the engaging portion 20 of the shank 2, an elastic member 221 and a detent 222 received by the cavity 21. Further, the two detents 222 are adapted to be received by the two dents 13 respectively.

The two positioning devices 3 are utilized for holding the two prongs 1 stationary with respect to the engaging portion 20 of the shank 2 respectively. In this embodiment, the positioning devices 3 are operable to move between a first position and a second position. When the two prongs 1 are held stationary on the engaging portion 20, the two positioning devices 3 are operably moved to the first positions thereof. The two positioning devices 3 are engaged with two of the plurality of retaining portions 23 respectively. Further, when the two prongs are moveable on the engaging portion, the two positioning devices are operably moved to the second positions thereof.

Each of the two positioning devices 3 includes a controller 30 having a first section 32 and a second section 33 connected to the first section 32. The first section 32 has a first cross section, and the second section 33 has a second cross section. The first cross section is larger than the second cross section. Each of the two positioning devices 3 further includes a hooking portion 34 on the second section 33. Preferably, the hooking portion 34 is a protrusion extended outward of the second section 33. Each of the two controllers 30 further includes a surrounding elastic element 35. The elastic elements 32 are received by the large diametrical sections of the two compartments 12 respectively. Each of the two controllers 30 further includes an operation end 31 connected to the first section 32 for a user to push during operation thereof.

When the two prongs 1 are held stationary on the engaging portion 20 of the shank 2, the hooking portions 34 of the two positioning devices 3 are abutted by two of the plurality of retaining portions 23 respectively.

Figure 7:
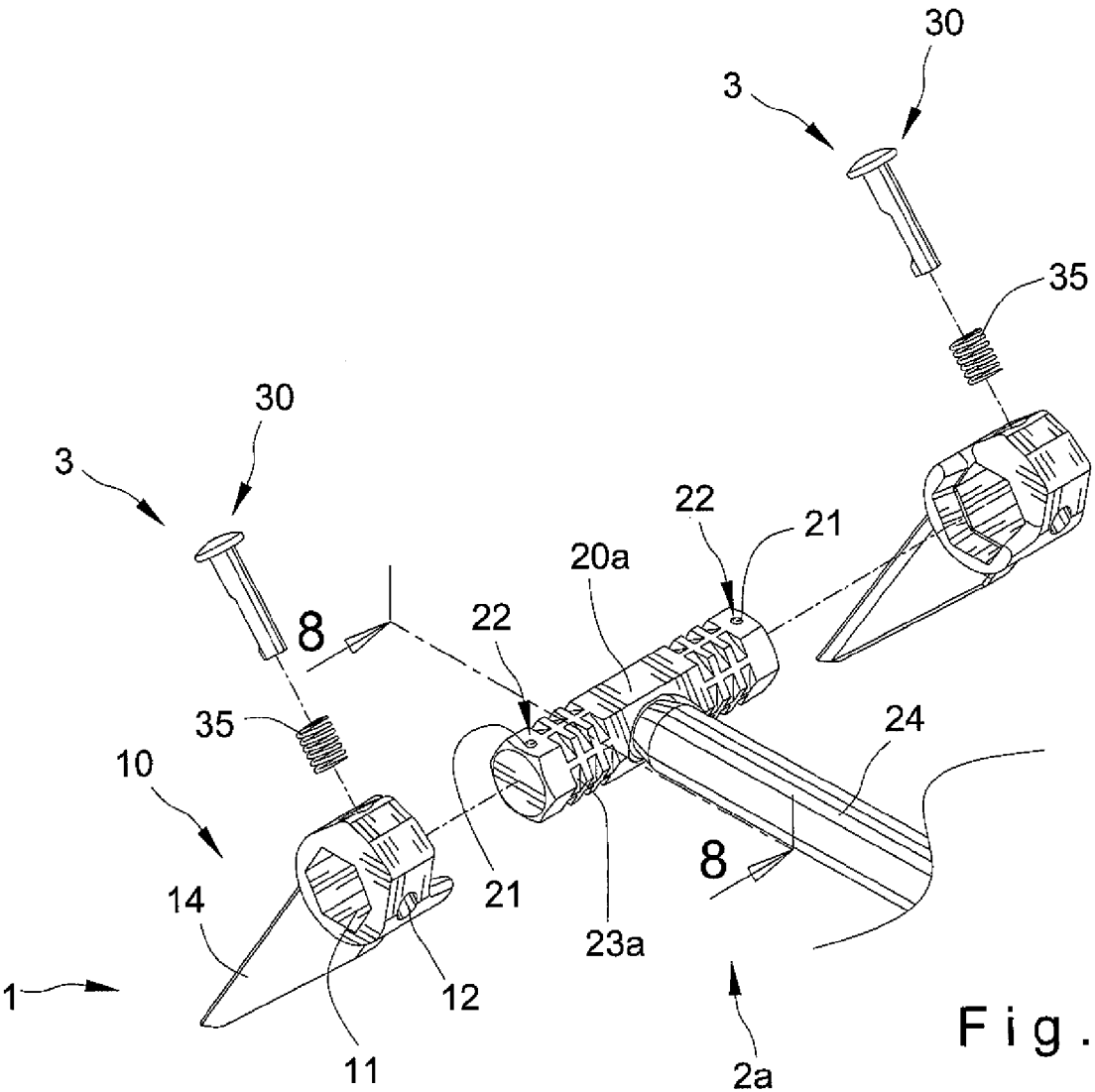
FIG. 7 is an exploded, perspective view of a prying tool in accordance with a second embodiment of the present invention, with a gripping portion of the prying tool shown partially.
Figure 8:
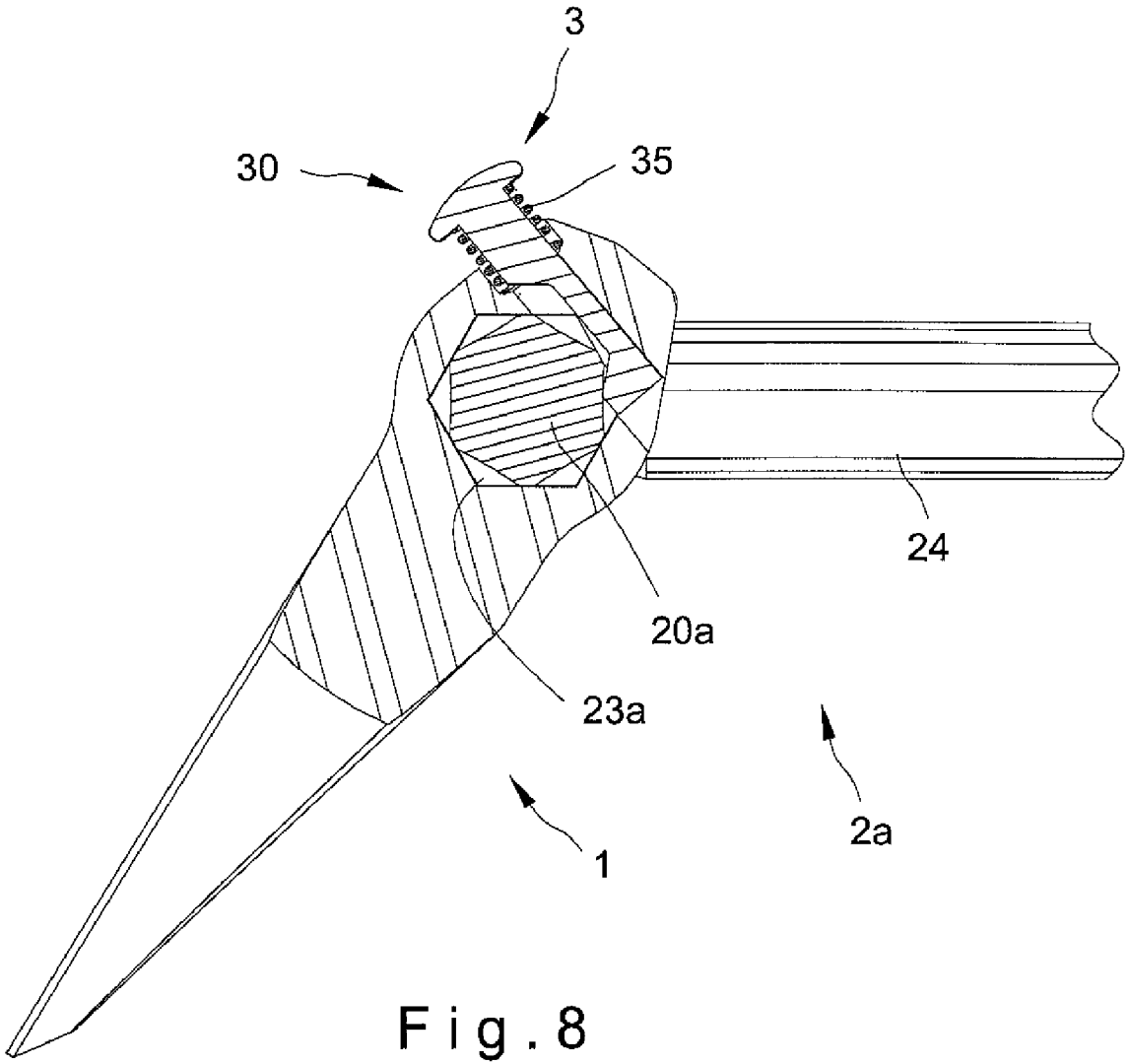
FIG. 8 is a cross-sectional view taken along line 8-8 of FIG. 7.

FIGS. 7 and 8 show a prying tool in accordance with a second embodiment of the present invention. This embodiment is similar to the first embodiment except that it includes a shank 2*a* having an engaging portion 20*a* having a plurality of retaining portions 23*a*. The plurality of retaining portions 23*a* are aligned with each other in a first direction and a second direction which is transverse to the first direction. In this embodiment, the plurality of the retaining portions 23*a* are disposed on the plurality of corners of the engaging portion 20*a* of the shank 2*a*. Thus, even if the two prongs 1 are orientated with respect to the engaging portion 20*a* of the shank 2, the two prongs 1 are also adapted to be positioned near or further in relation to each other.

Figure 9:
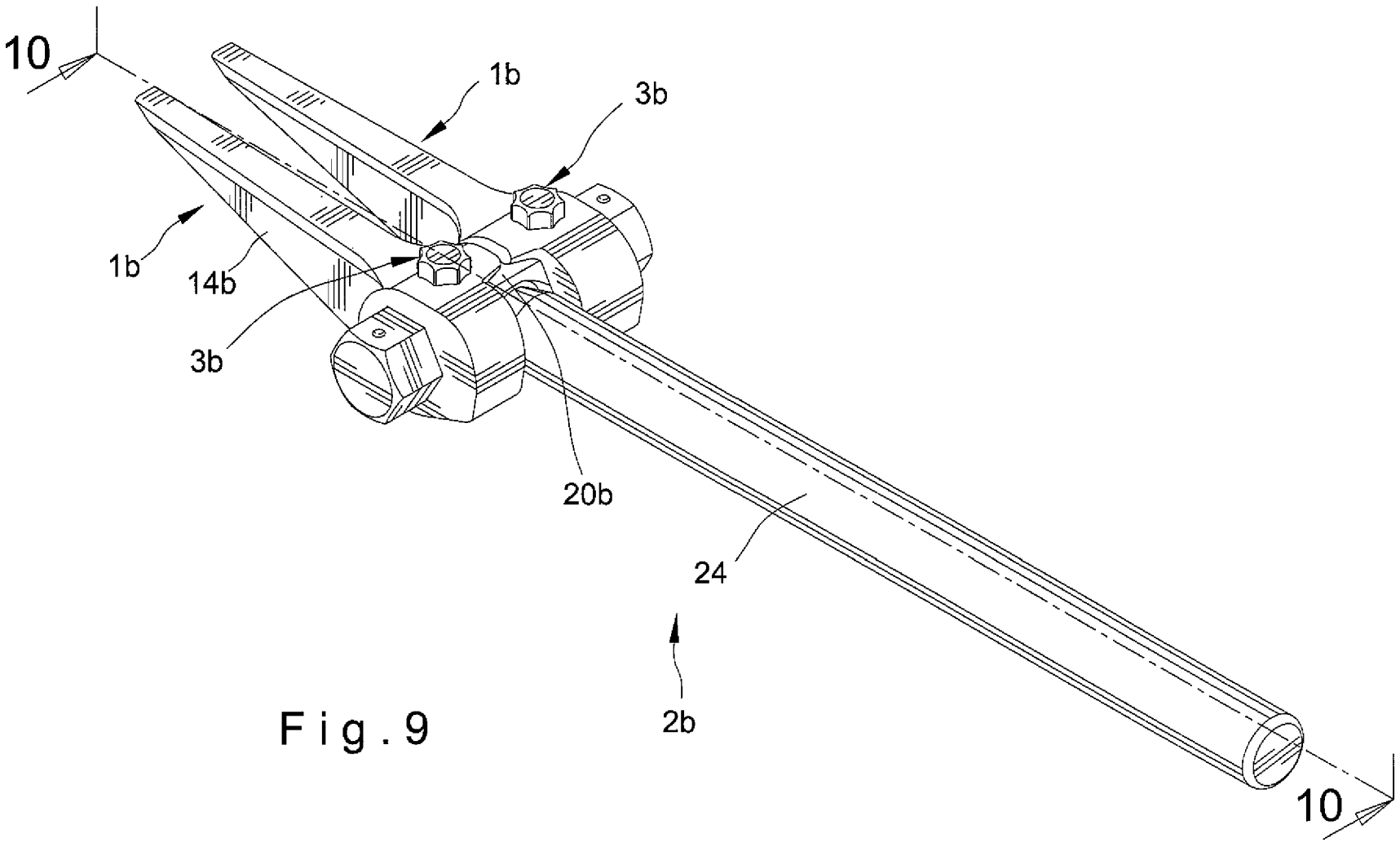
FIG. 9 is a perspective view of a prying tool in accordance with a third embodiment of the present invention.
Figure 10:
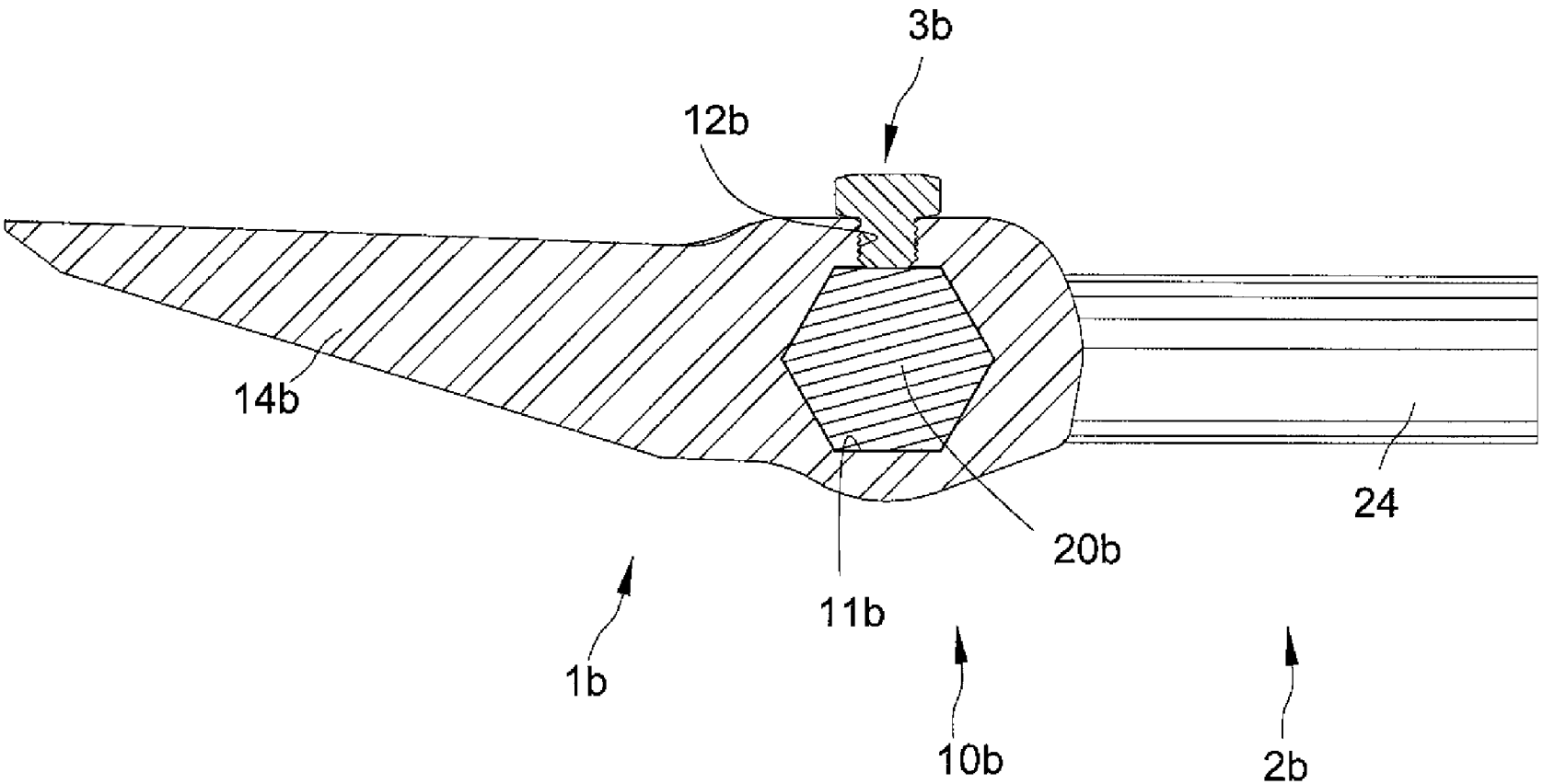
FIG. 10 is a cross-sectional view of line 10-10 of FIG. 9.

FIGS. 9 and 10 show a prying tool in accordance with a third embodiment of the present invention. The third embodiment differentiates from the first embodiment in that it includes two prongs 1*b* having a connecting portion 10*b* and a working portion 14*b*, a shank 2*b* having an engaging portion 20*b*, and two positioning devices 3*b*.

The connecting portion 10*b* of each of the two prongs 1*b* includes a through hole 11*b*. The proximal end of the engaging portion 20*b* of the shank 2*b* is inserted through the through hole 11*b* of one of the two prongs 1*b*, and the distal end of the engaging portion 20*b* of the shank 2*b* is inserted through the through hole 11*b* of the other of the two prongs 1*b*. The connecting portion 10*b* of each of the two prongs 1*b* further includes a compartment 12*b* in communication with the through hole 11*b* and in which one of the two positioning devices 3*b* is moveably received.

Each of the two positioning devices 3*b* includes a thread and a terminal end. The engaging portion 20*b* of the shank 2*b* includes a polygonal periphery and defines a plurality of sides, and one of the plurality of sides is selectively abutted by the terminal ends of the two positioning devices 3*b*.

Figure 11:
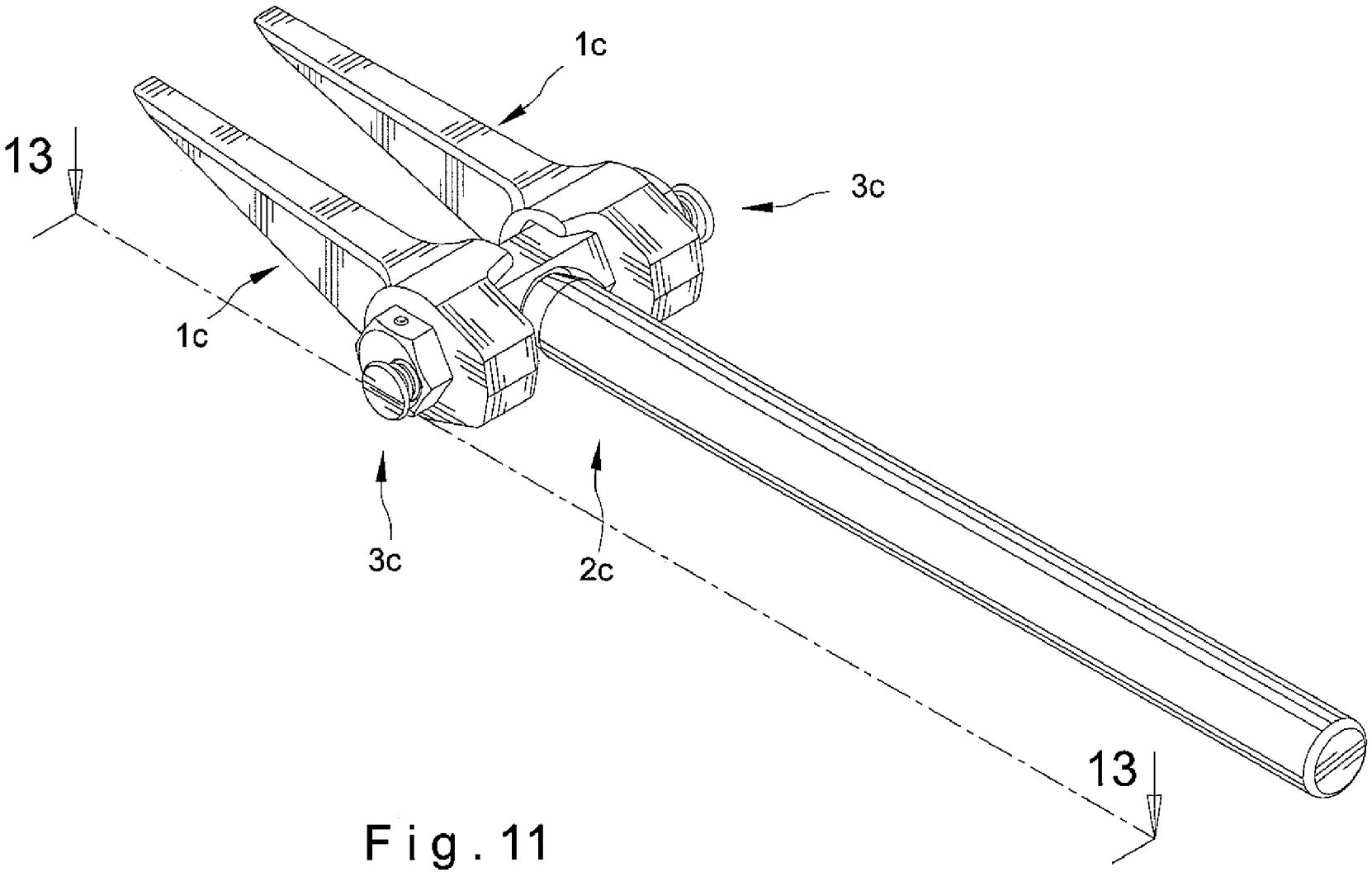
FIG. 11 is a perspective view of a prying tool in accordance with a fourth embodiment of the present invention.
Figure 12:
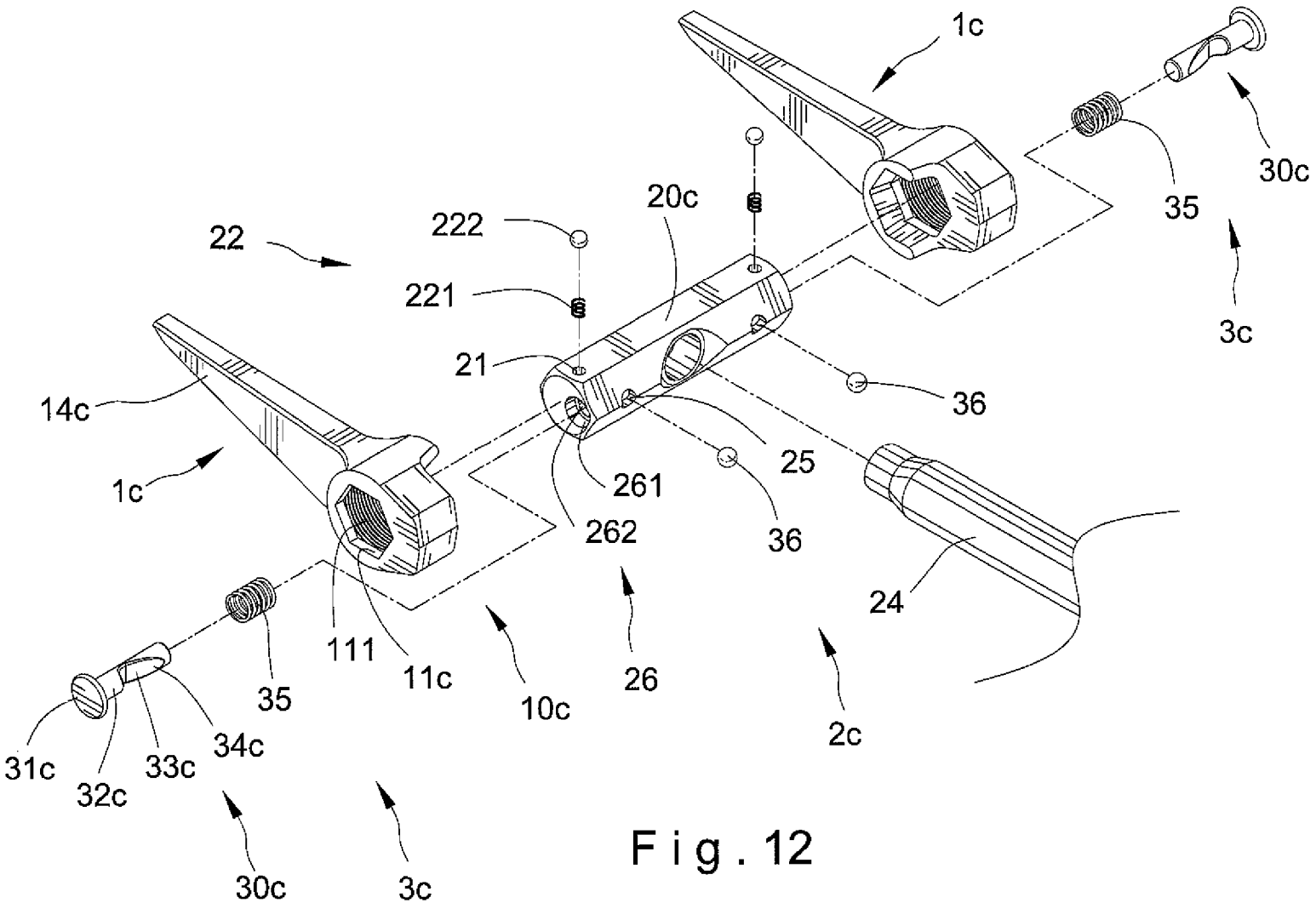
FIG. 12 is an exploded, perspective view of the prying tool shown in FIG. 11, with a gripping portion of the prying tool shown partially.
Figure 13:
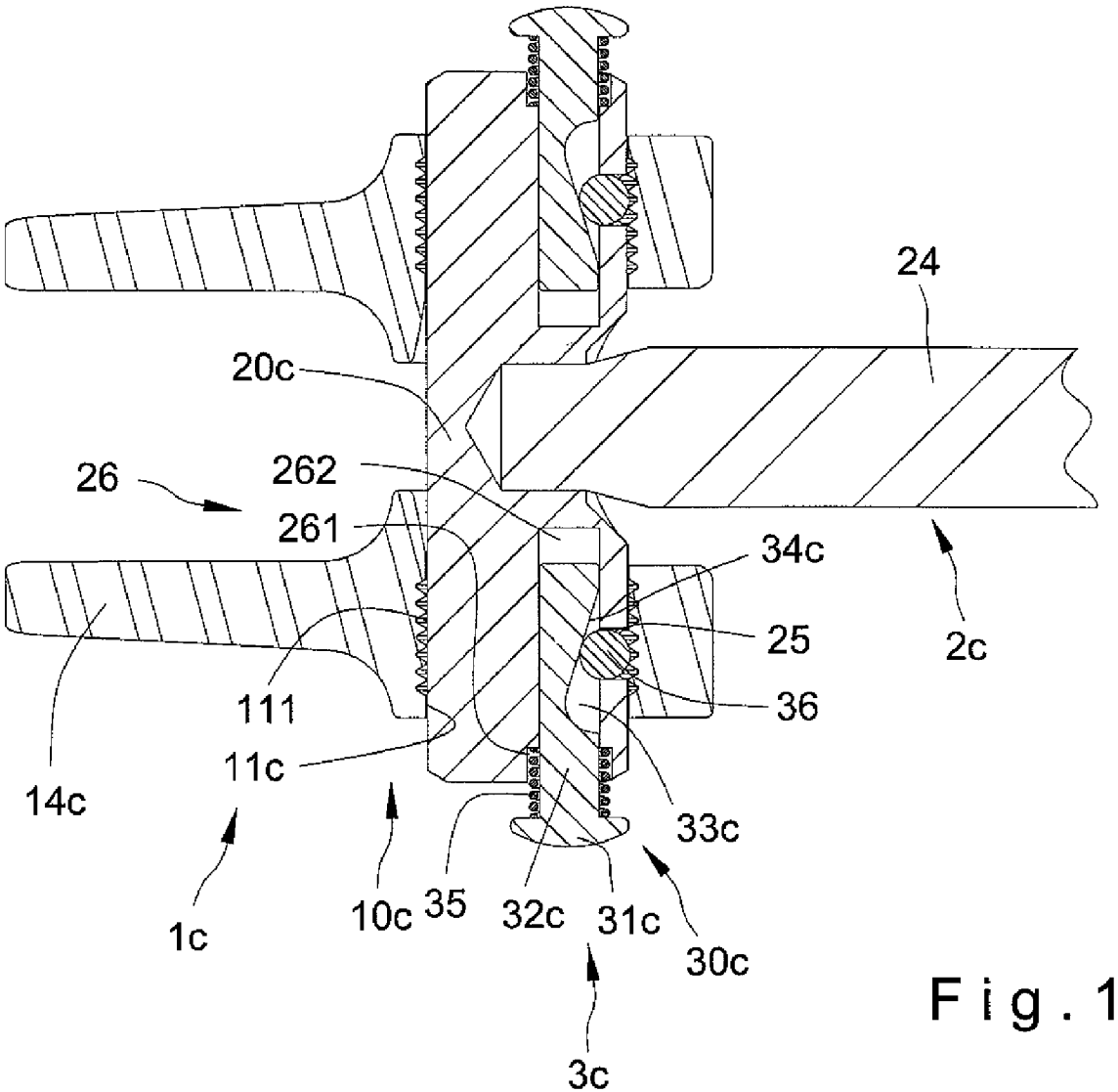
FIG. 13 is a cross-sectional view taken along line 13-13 of FIG. 11.

FIGS. 11 through 13 show a prying tool in accordance with a fourth embodiment of the present invention. The fourth embodiment differentiates from the first embodiment in that it includes two prongs 1*c* having a connecting portion 10*c* and a working portion 14*c*, a shank 2*c* having an engaging portion 20*c* which includes two holes 26 and two slots 25 extended transverse to and in communication with the two holes 26 respectively, and two positioning devices 3*c* moveably received in the two holes 26 respectively. Additionally, each of the two holes 26 includes a large diametrical section 261 and a small diametrical section 262.

The connecting portion 10*c* of each of the two prongs 1*c* includes a through hole 11*c* having an inner thread 111 circumferentially formed therein. The proximal end of the engaging portion 20*c* of the shank 2*c* is inserted through the through hole 11*c* of one of the two prongs 1*c*, and the distal end of the engaging portion 20*c* of the shank 2*c* is inserted through the through hole 11*c* of the other of the two prongs 1*c*.

Each of the two positioning devices 3*c* includes a controller 30*c* having a first section 32*c* and a second section 33*c*, and the second section 33*c* includes two slanted surfaces extended inward of the controller 30*c*. The two slanted surfaces each has a proximal end connected to each other, and one of the two slanted surfaces has a distal end defining a hooking portion 34C. Each of the two positioning devices 3*c* further includes a retainer 36 received by one of the slots 25, and the retainer 36 is operably moved by one of the controllers 30*c* and selectively urged to abut a periphery of one of the through holes 11*c*. Each of the two controllers 30*c* includes a surrounding elastic element 35. The elastic elements 35 are received in the large diametrical sections of the two holes 26 respectively. Each of the two controllers 30*c* further includes an operation end 31*c* connected to the first section 32 for a user to push during operation thereof.

When the two prongs 1*c* are held stationary on the engaging portion 20*c* of the shank 2*c*, the hooking portions 34*c* of the two positioning devices 3*c* urge the two retainers 36 to abut against the peripheries of the two through holes 11*c* respectively.

While the specific embodiments have been illustrated and described, numerous modifications come to mind without significantly departing from the spirit of invention, and the scope of invention is only limited by the scope of accompanying claims.

What is claimed is:

1. A prying tool comprising:

a shank including an engaging portion and a gripping portion connected transversely to the engaging portion;

two prongs moveably mounted on the engaging portion of the shank and each including a connecting portion connected to the engaging portion of the shank and a working portion projected from the connecting portion, with the two working portions defining a space therebetween, with the space having a first size when one of the two prongs is positioned at a proximal end of the shank and another of the two prongs is positioned at a distal end of the shank, with the space having a second size when the two prongs are in proximity to each other, with the size of the space being variable between the first and second sizes; and two positioning devices for holding the two prongs stationary with respect to the engaging portion of the shank respectively, with the two positioning devices moveably mounted to the two prongs and operable to move relative to the engaging portion between a first position and a second position; and wherein when the two prongs are held stationary on the engaging portion, the two positioning devices are operably moved to the first positions thereof and wherein when the two prongs are moveable on the engaging portion, the two positioning devices are operably moved to the second positions thereof.

2. The prying tool as claimed in claim 1 wherein the engaging portion of the shank includes a periphery having a plurality of retaining portions spaced from each other in a first direction between the two prongs and along the engaging portion, and wherein when the two prongs are held stationary on the engaging portion of the shank, the two positioning devices are engaged with two of the plurality of retaining portions respectively.

3. The prying tool as claimed in claim 2 wherein the plurality of the retaining portions are recesses and are inset on the engaging portion of the shank.

4. The prying tool as claimed in claim 3 wherein the plurality of the retaining portions is aligned with each other in the first direction.

5. The prying tool as claimed in claim 4 wherein the plurality of the retaining portions is aligned with each other in a second direction, with the first direction transverse to the second direction.

6. The prying tool as claimed in claim 4 wherein the periphery of a cross section of the engaging portion of the shank parallel to the gripping portion is polygonal and defines a plurality of sides and corners each interconnecting two of the plurality of sides, and wherein the plurality of the retaining portions are disposed on one of the plurality of corners.

7. The prying tool as claimed in claim 5 wherein the periphery of a cross section of the engaging portion of the shank parallel to the gripping portion is polygonal and defines a plurality of sides and corners each interconnecting two of the plurality of sides, and wherein the plurality of the retaining portions are disposed on the plurality of corners.

8. A prying tool comprising:

a shank including an engaging portion and a gripping portion connected transversely to the engaging portion;

two prongs moveably mounted on the engaging portion of the shank and each including a connecting portion connected to the engaging portion of the shank and a working portion projected from the connecting portion, with the two working portions defining a space therebetween, with the space having a first size when one of the two prongs is positioned at a proximal end of the shank and another of the two prongs is positioned at a distal end of the shank, with the space having a second size when the two prongs are in proximity to each other, with the size of the space being variable between the first and second sizes; and two positioning devices for holding the two prongs stationary with respect to the engaging portion of the shank respectively, with each of the two positioning devices being operable to move between a first position and a second position; and wherein when the two prongs are held stationary on the engaging portion, the two positioning devices are operably moved to the first positions thereof and wherein when the two prongs are moveable on the engaging portion, the two positioning devices are operably moved to the second positions thereof, wherein each of the two positioning devices includes a controller having a first section and a second section connected to the first section, with the first section having a first cross section and the second section having a second cross section, with the first cross section being larger than the second cross section, wherein each of the two positioning devices further includes a hooking portion, with the hooking portion on the second section, and wherein when the two prongs are held stationary on the engaging portion of the shank, the hooking portions of the two positioning devices are abutted by the two of the plurality of retaining portions respectively.

9. The prying tool as claimed in claim 7 wherein each of the two positioning devices includes a controller having a first section and a second section connected to the first section, with the first section having a first cross section and the second section having a second cross section, with the first cross section being larger than the second cross section, wherein each of the two positioning devices further includes a hooking portion, with the hooking portion on the second section, and wherein when the two prongs are held stationary on the engaging portion of the shank, the hooking portions of the two positioning devices are abutted by the two of the plurality of retaining portions respectively.

10. The prying tool as claimed in claim 8 wherein the connecting portion of each of the two prongs includes a through hole, wherein the proximal end of the engaging portion of the shank is inserted through the through hole of the one of the two prongs and the distal end of the engaging portion of the shank is inserted through the through hole of the other of the two prongs, wherein the connecting portion of each of the two prongs further includes a compartment in communication with the through hole, wherein the engaging portion of the shank includes two portions of a periphery received by the two compartments, and wherein the two positioning devices are moveably received in the two compartments respectively.

11. The prying tool as claimed in claim 9 wherein the connecting portion of each of the two prongs includes a through hole, wherein the proximal end of the engaging portion of the shank is inserted through the through hole of the one of the two prongs and the distal end of the engaging portion of the shank is inserted through the through hole of the other of the two prongs, wherein the connecting portion of each of the two prongs further includes a compartment in communication with the through hole, wherein the engaging portion of the shank includes two portions of the periphery received by the two compartments, and wherein the two positioning devices are moveably received in the two compartments respectively.

12. The prying tool as claimed in claim 10 wherein each of the two controllers includes a surrounding elastic element, wherein each of the two compartments includes a large diametrical section and a small diametrical section, and wherein the elastic elements are received by the large diametrical sections of the two compartments respectively.

13. The prying tool as claimed in claim 11 wherein each of the two controllers includes a surrounding elastic element, wherein each of the two compartments includes a large diametrical section and a small diametrical section, and wherein the elastic elements are received by the large diametrical sections of the two compartments respectively.

14. The prying tool as claimed in claim 1 wherein each of the two positioning devices includes a thread and a terminal end.

15. The prying tool as claimed in claim 14 wherein the connecting portion of each of the two prongs includes a through hole, wherein the proximal end of the engaging portion of the shank is inserted through the through hole of the one of the two prongs and the distal end of the engaging portion of the shank is inserted through the through hole of the other of the two prongs, wherein the connecting portion of each of the two prongs further includes a compartment in communication with the through hole, wherein the engaging portion of the shank includes a periphery, with the periphery being polygonal and defines a plurality of sides, wherein the two positioning devices are moveably received by the two compartments, and wherein one of the plurality of sides is selectively abutted by the terminal ends of the two positioning devices.

16. The prying tool as claimed in claim 1 wherein each of the two positioning devices includes a controller having a first section and a second section, with the second section including two slanted surfaces extended inward of the controller and each having a proximal end connected to each other, and with one of the two slanted surfaces having a distal end defining a hooking portion.

17. The prying tool as claimed in claim 16 wherein the connecting portion of each of the two prongs includes a through hole, wherein the proximal end of the engaging portion of the shank is inserted through the through hole of the one of the two prongs and the distal end of the engaging portion of the shank is inserted through the through hole of the other of the two prongs, wherein the engaging portion of the shank includes two holes and two slots in communication with the two holes respectively, with each hole extended transverse to the slot, wherein the two positioning devices are moveably received in the two holes respectively, wherein each of the two positioning devices further includes a retainer received by the slot, with the retainer operably moved by the controller and selectively urged to abut a periphery of the through hole, and wherein when the two prongs are held stationary on the engaging portion of the shank, the hooking portions of the two positioning devices urge the two retainers to abut against the peripheries of the two through holes respectively.

18. The prying tool as claimed in claim 17 wherein each of the through holes includes an inner thread circumferentially formed therein.

19. The prying tool as claimed in claim 17 wherein each of the two controllers includes a surrounding elastic element, wherein each of the two holes includes a large diametrical section and a small diametrical section, and wherein the elastic elements are received in the large diametrical sections of the two holes respectively.

* * * * *